United States Patent [19]

Leonard, Jr. et al.

[11] Patent Number: 4,925,226

[45] Date of Patent: May 15, 1990

[54] MANUALLY OPERATED CARGO CONTAINER HOOK APPARATUS

[75] Inventors: Laurence E. Leonard, Jr.; Dennis A. Mostad, both of Honolulu, Hi.

[73] Assignee: Hawaii Stevedores, Inc., Honolulu, Hi.

[21] Appl. No.: 232,937

[22] Filed: Aug. 17, 1988

[51] Int. Cl.[6] ..... B66C 1/22

[52] U.S. Cl. ..... 294/82.1; 294/82.17; 294/102.1; 294/81.53; 410/101

[58] Field of Search ..... 294/82.1, 82.11, 82.15, 294/82.17, 82.23, 89, 94, 102.1, 81.53, 93; 410/101, 116

[56] References Cited

U.S. PATENT DOCUMENTS

| | | | |
|---|---|---|---|
| 981,365 | 1/1911 | Birnie et al. | 294/89 |
| 1,866,350 | 7/1932 | Holden . | |
| 2,560,525 | 7/1951 | Nyl | 287/20 |
| 2,963,310 | 12/1960 | Abolins | 294/67 |
| 3,368,838 | 2/1968 | Reich | 294/83 |
| 3,501,193 | 3/1970 | Gray | 294/67 |
| 3,612,466 | 10/1971 | Arnold | 296/35 |
| 3,749,438 | 7/1973 | Loomis et al. | 294/81 |
| 3,792,892 | 2/1974 | Shields | 294/82 |
| 3,845,527 | 11/1974 | Lombardi | 24/221 |
| 3,892,436 | 7/1974 | Fathauer | 294/81 |
| 3,917,338 | 11/1975 | Becker | 410/116 |
| 4,068,878 | 1/1978 | Wilner | 294/83 |
| 4,139,228 | 2/1979 | Varadi | 294/83 |
| 4,231,709 | 11/1980 | Corsetti | 294/81.53 X |
| 4,828,308 | 5/1989 | Riedl | 294/81.53 |

FOREIGN PATENT DOCUMENTS

| | | | |
|---|---|---|---|
| 895895 | 1/1982 | U.S.S.R. | 294/89 |

*Primary Examiner*—Margaret A. Focarino
*Assistant Examiner*—Dean J. Kramer
*Attorney, Agent, or Firm*—Fulwider Patton Lee & Utecht

[57] ABSTRACT

A simple two component manually operated container hook for efficiently engaging a container's lift fitting and safely lifting the container. The configuration of the hook member allows it to be quickly maneuvered into an engaging position within the lift fitting and the lowering of a lock plug into the remaining void within the lift fitting positively locks the hook member in place.

10 Claims, 2 Drawing Sheets

MANUALLY OPERATED CARGO CONTAINER HOOK APPARATUS

BACKGROUND OF THE INVENTION

The present invention relates generally to a shipping container coupling and more particularly pertains to a very simple and safe manually operated container hook design.

The use of shipping containers has gained almost universal acceptance in the inter-modal movement of cargo throughout the world. The containers are alternately trucked, shipped, hauled or stored without the need to handle the cargo therein. Fully laden containers are simply lifted onto a trailer truck, rail car, freighter deck, placed in a freighter hold or efficiently stacked in storage yards.

Such containers are provided with cast lift fittings at each corner by which the containers may easily be grasped and lifted. The lift fitting normally includes a standardized hollow cubic structure formed with a cavity and having an elongated slot in its top wall. A variety of hook designs are capable of engaging this type of lift fitting. Generally an elongated coupling hook is lowered through the slot into the interior of the fitting where it is subsequently rotated to a position transverse to the length of the slot. Various methods of locking the elongated hook in this position are subsequently employed which then allows the container to be safely lifted.

In order to expedite the process of engaging and lifting the containers, rigid overhead spreaders are generally suspended from a crane for disposition over the container to locate four hooking devices disposed in vertical alignment over the respective slots. After insertion into the respective lift fittings, the hooks are automatically rotated into a transverse position relative to the elongated slots to be locked into place.

When an automatic container spreader is unavailable or, if a shipping container has been badly damaged or is wracked out of square thereby precluding the use of an automatic spreader, a set of four manually operated hooks can be used to engage and hoist the container by the lift fittings. In addition, it sometimes becomes necessary to use manually operated hooks when the containers are awkwardly positioned or jammed within the below deck cells of a container vessel.

The prior art provides a number of designs adapted for such manual engagement of a container's lift fittings. Representative examples of varying complexity are described in Wilner U.S. Pat. No. 4,068,878, Lombardi U.S. Pat. No. 3,845,527 and Varadi U.S. Pat. No. 4,139,228. All three designs employ moving parts to fulfill the functions of engaging and locking onto a lift fitting. The use of moving parts adds to the cost of manufacture and normally requires at least some maintenance. In addition, moving parts are susceptible to becoming jammed and can malfunction thereby preventing either proper engagement or disengagement with a container. The use of rather delicate parts in the design described in Varadi renders the device especially prone to failure and in need of maintenance.

Shields in U.S. Pat. No. 3,792,892 describes a lifting hook, which, although extremely simple in design, presents a number of disadvantages in its function. As was indicated above, it is often necessary to extract containers jammed into below deck cells, oftentimes positioned at extreme angles or inclinations. It is possible that, upon engagement with the lifting hook described in this patent the container could shift and roll to angles which would allow the hooks to disengage. In addition, a slackening of the cables while manipulating a container can similarly allow a hook to disengage. Furthermore the described design precludes movement of the hooks in a plane perpendicular to the container's grasped surface thereby causing undue strain to be applied to the hook and the hoist cable, if the attached container is positioned in or moves through an extreme angle relative to the horizontal.

SUMMARY OF THE INVENTION

It is an object of the present invention to provide an extremely simple and robust manually operated container hook design.

Another object of the invention is to provide a manually operated container hook design that is maintenance free.

A further object of the invention is to provide a design that employs no moving parts that can jam or become misaligned.

Yet another object of the invention is to provide a manually operated container hook that can be positively locked in place within the container's lift fitting to be constrained against unlocking even in the event of a sudden weight shift or angled displacement of the container or via a slackening of a hoist cable.

A further object of the invention is to provide a diagram wherein the hook has some freedom of movement in a plane perpendicular to the grasped surface of the container.

According to the present invention, the foregoing and other objects are attained by the described manually operated container hook design. To attain this objective, the present invention provides a unique two-component coupling design including a T-shaped hook member and a cylindrical locking plug. The T-shaped hook member is formed with a crossbar receivable lengthwise through the slot to be disposed in the interior cavity of the lift fitting. The hook member may then be rotated to a locked position such that the crossbar is substantially perpendicular to the slot. In the locked position, the ends of the crossbar are engaged under the top wall on the opposite sides of the slot in the lift fitting. The ends of the crossbar are of sufficient size to bear the weight of the lifted container and are of substantially cylindrical cross section to allow free rotation of the hook member about the crossbar's axis in response to lifting forces applied thereto from different angles. The hook member is formed with a shank having an eye therein to allow for attachment to a hoist cable via, for example, a shackle. The hook member may then be positioned at one end of the slot and a lock plug then inserted into the opposite end of such slot to occupy the void remaining in the interior of a lift fitting to lock such hook member from rotating within the cavity to positively lock it in place. The lock plug may be conveniently attached to the hook member or shackle via, for example, a length of chain.

While the two components are ultimately coacting, no moving parts are employed that would require maintenance or that could be misaligned or damaged in some way so as to malfunction. Each of the two components is of heavy steel construction and is therefore virtually indestructible.

Other objects and many of the attendant advantages of this invention will be readily appreciated as the same becomes better understood by reference to the following detailed description when considered in conjunction with the accompanying drawings.

DETAILED DESCRIPTION OF THE PREFERRED EMBODIMENT

Figure 1:
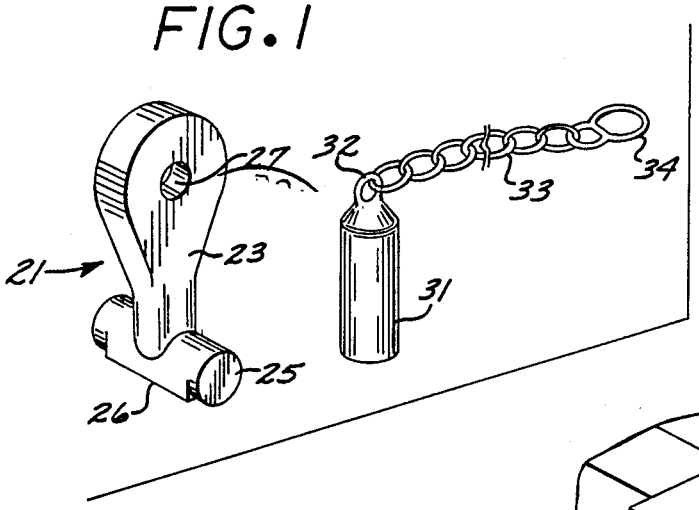
FIG. 1 is a perspective view of the manually operated container hook apparatus of the present invention.

FIG. 1 illustrates the two components of the container coupling of the present invention consisting, generally, of a hook member 21 and a lock plug 31. The hook member comprises a substantially cylindrical crossbar 25 formed on one end of an elongated shank 23. The center section 26 of the crossbar 25 is squared off on its distal side to act as a foot to allow the hook member to stand on end as is illustrated in the Figure. The upper portion of the shank is formed with an eye 27 or other convenient attachment arrangement to facilitate interconnection with, for example, a hoist cable 41 via a shackle 35. The lock plug 31, as illustrated in the drawings, preferably includes a round peg, but a variety of shapes of sufficient length and bulk would serve its function. An eyelet 32 may be formed on one end of the lock plug to provide a handle or enable the fitting of a tether. A tether chain 33 is connected between the eyelet 32 and a pin 37 which secures the hook member to the shackle 35.

Figure 2:
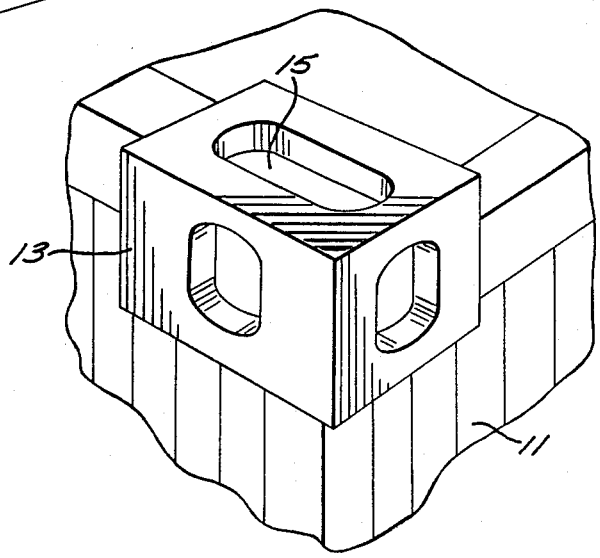
FIG. 2 is a perspective view of a shipping container lift fitting with which the hook apparatus of the present invention may be used.
Figure 7:
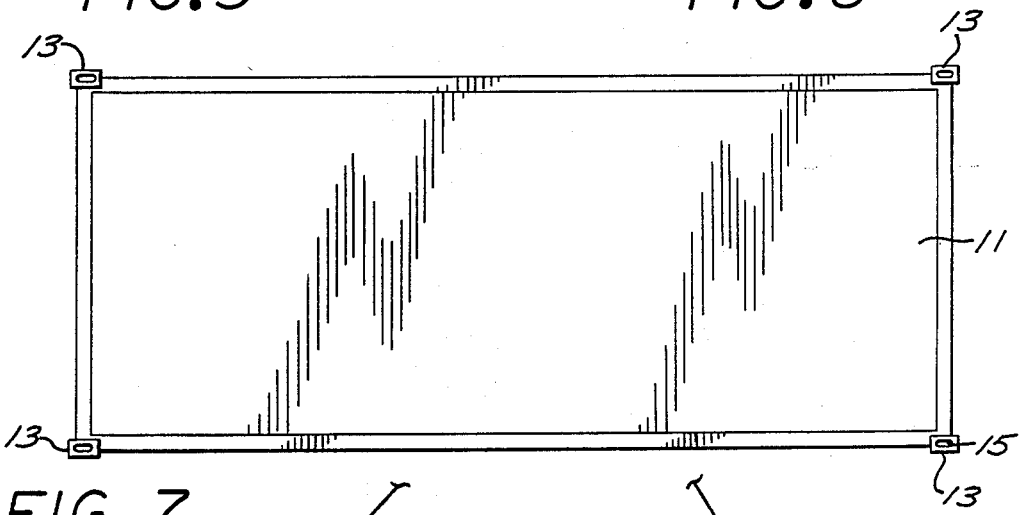
FIG. 7 is a top plan view, in reduced scale, of a container illustrating the location of the lift fittings shown in FIG. 2.
Figure 8:
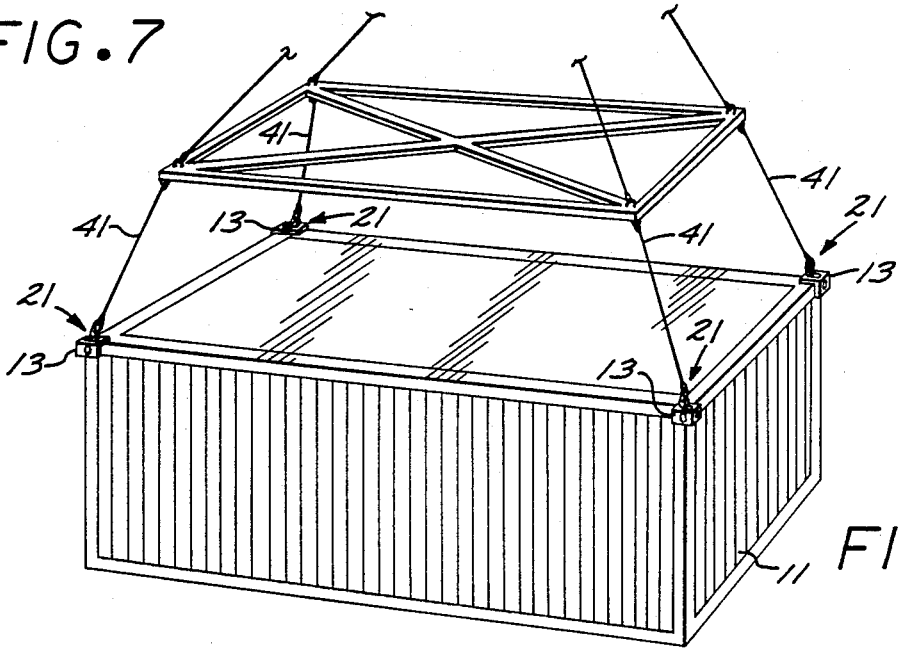
FIG. 8 is a partial perspective view, in reduced scale, of the container shown in FIG. 8, being hoisted via the hook apparatus of the present invention.

The manually operated container hook of the present invention is designed to be used with a standard type lift fitting 13 as found on most shipping containers. FIG. 7 is a top plan view of a shipping container 11 illustrating the location of four such fittings 13 while FIG. 2 is a close-up perspective view of an individual lift fitting 13 on such a container. Each lift fitting 13, shaped in the form of an elongated cube, is a heavy casting having a hollow interior defining a cavity formed in its top will with an elongated slot 15.

Figure 3:
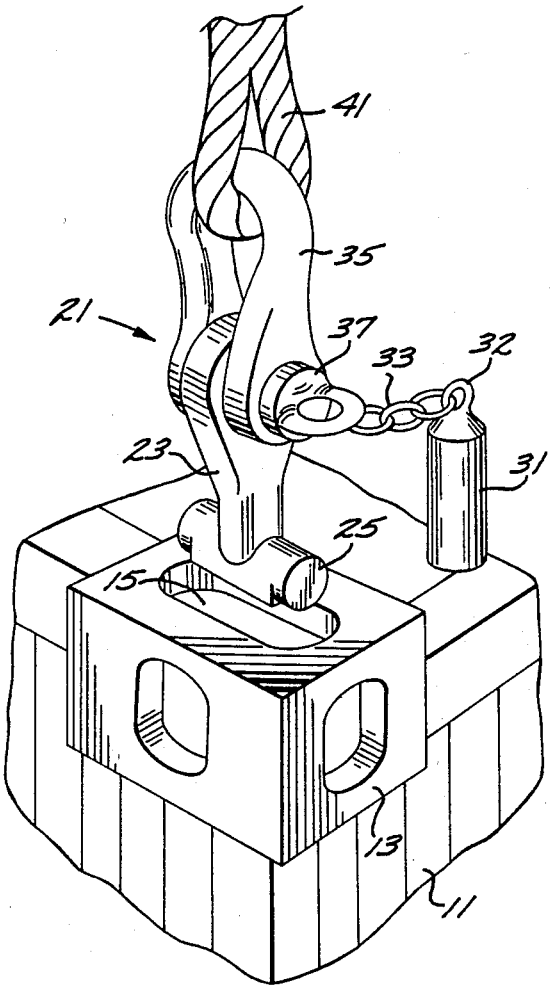
FIG. 3 is a perspective view of the container hook apparatus of the present invention disposed for engagement with the lift fitting shown in FIG. 2.

The dimensions of the hook member 21 are selected such that the crossbar 25, when rotated lengthwise to such slot 15 as viewed in FIG. 3, will pass freely downwardly through the slot 15 to be subsequently rotated therein. This requires that the crossbar be both slightly shorter than the length of the slot and short enough to allow its rotation about the shank while within the interior cavity without fouling the slides of the fitting. (See FIG. 6.) On the other hand, the cross bar must be sufficiently long to, when rotated sideways, project a substantial distance on the opposite side of the slot 15 to facilitate the lifting of heavy loads. Additionally, a sufficient length precludes excessive side to side movement within the fitting. A crossbar, nominally 4½" in length and 2" in diameter, fulfills these requirements. The diameter of the shank 23 near the crossbar must be smaller than the width of the slot 15 for obvious reasons. A lock plug 2" in diameter and approximately 5" in length allows for unhindered lowering thereof into the lift fitting via the slot and exhibits a sufficiently large cross section to effectively occupy one end of the cavity to block the crossbar 25 from rotating within the interior of the lift fitting thereby holding it in its locked position.

Figure 4:
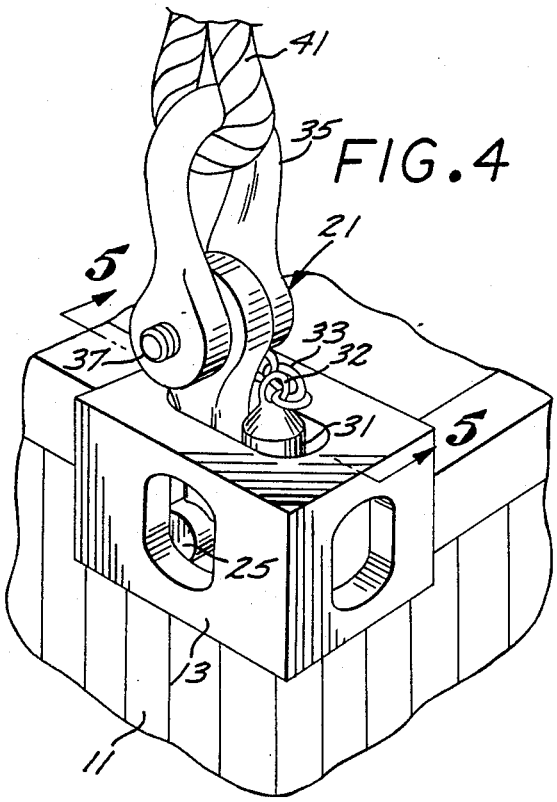
FIG. 4 is a perspective view of the container hook apparatus of the present invention fully engaged with the lift fitting shown in FIG. 2.
Figure 5:
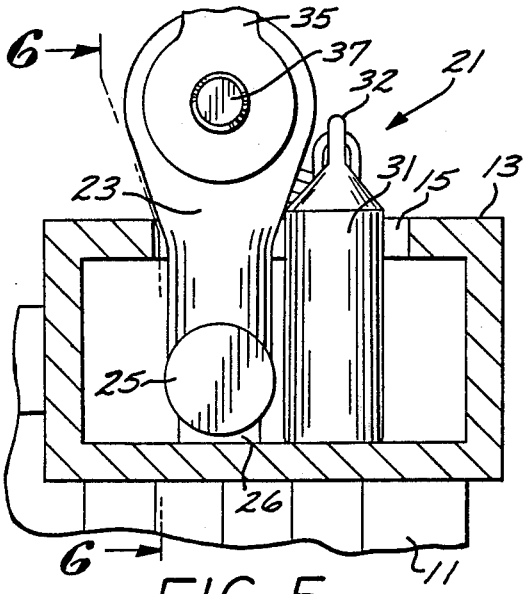
FIG. 5 is a partial sectional view, in enlarged scale, taken along the line 5—5 of FIG. 4.
Figure 6:
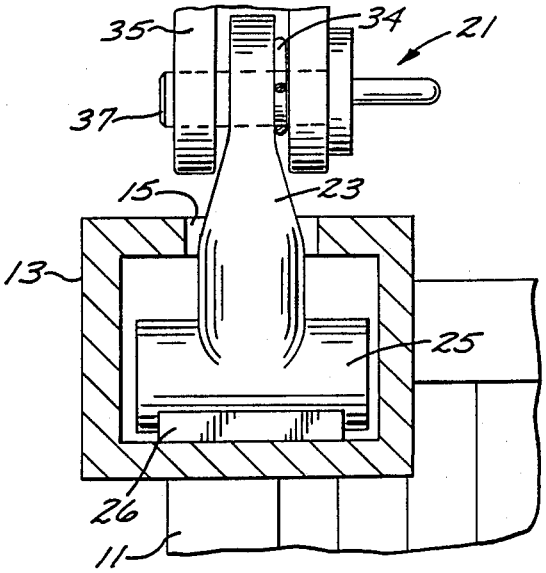
FIG. 6 is a partial sectional view taken along the lines 6—6 of FIG. 5.

The function of the manually operated container hook design should be obvious from its described and illustrated form. As shown in FIG. 3, the hook member 21 and lock plug 31 is preferably shackled to the end of a hoist cable 41 by means of the shackle 35 (FIG. 6). To engage a lift fitting, the crossbar is aligned with the slot 15 and lowered therethrough into the cavity of the lift fitting 13. Once disposed within such cavity, the hook member 21 is rotated approximately 90° and slid to one end of the slot. The void remaining near the other end of the slot is subsequently plugged by insertion of the lock plug 13. In this configuration (See FIGS. 4 and 5) the hook will remain positively locked in place while loads on the hook member vary from the unloaded condition to heavy loads and while the container is moved through extreme angles of inclinations.

Disengagement requires the reversed procedure. After the cable is slacked off, the lock plug is lifted out, the hook member shifted towards the center, rotated 90° and extracted from the lift fitting. As is illustrated in FIGS. 5 and 6 the squared off section 26 of the crossbar 25 serves as a foot allowing the hook member 21 to stand on the floor of the lift fitting thereby making it easier to handle and, in some instances, transforming the subsequent insertion of the lock plug 31 into the lift fitting into a one-handed operation. Under load, the crossbar 25 engages the underside of the top wall of the lift fitting 13 and the cylindrical or rounded configuration of the crossbar ends 25 frees the hook member to acquire a position angled towards the central point of attachment thereby providing assurance that the shank 23 is maintained in tension to minimize any shear loading thereof.

From the foregoing it will be appreciated that the cargo container hook apparatus of the present invention provides an economical and foolproof means for attaching to container lift fittings and for positively locking the hook member in such fittings for convenient lifting of containers which might otherwise be unaccessible to conventional automated lifting devices.

Obviously many modifications and variations of the present invention are possible in light of the above teachings. It is therefore to be understood that within the scope of the appended claims, the invention may be practiced otherwise than as specifically described.

What is claimed is:

1. A cargo container hook apparatus for engaging a hollow life fitting defining a cavity, said hollow lift fitting having a top wall having an elongated slot formed therethrough and comprising:

a hook member having a crossbar formed on one end of a shank, dimensioned to allow insertion of the crossbar through said elongated slot and to allow its subsequent rotation within said cavity of said lift fitting about an axis described by the shank, said crossbar having a pair of opposing distal ends formed in a substantially cylindrical crosssectional contour, whereby said hook member is free to rotate about an axis defined by said crossbar responsive to lifting forces applied thereto; and means for obstructing a sufficient amount of the cavity of said lift fitting to substantially limit rotation of the hook member from a position wherein the crossbar is substantially perpendicular to said elongated slot, said obstructing means includes a lock plug insertable into said cavity of said lift fitting through said elongated slot, wherein a first end of said lock plug is disposed external said cavity and an opposing second end is positioned in contiguous contact with a bottom wall surface of said cavity.

2. The cargo container hook apparatus of claim 1 wherein the central section of the crossbar is squared off such that the hook member will freely stand with the shank projecting upwardly.

3. The cargo container hook apparatus of claim 1 wherein the end of the hook member shank opposite the crossbar is formed to accommodate a lifting member.

4. The cargo container hook apparatus of claim 1 wherein the lock plug comprises a substantially cylindrical member.

5. The cargo container hook apparatus of claim 4 wherein the cylindrical member has an eyelet formed at one end to accommodate a means for tethering the lock plug to or near the hook member.

6. The cargo container hook apparatus of claim 4 wherein the tethering means comprises a length of chain.

7. A two component manually operated cargo container hook apparatus for engaging a top wall of a hollow lift fitting through a slotted opening formed therethrough, said hollow lift fitting defining a cavity, included in a shipping container and comprising:

a hook member having a substantially cylindrical crossbar perpendicularly affixed to a shank, said crossbar having a length dimension slightly less than a length dimension of said slotted opening and a cross-sectional dimension slightly less than a width dimension of said slotted opening; and a substantially cylindrical lock plug, of a length dimension slightly greater than a depth dimension of the lift fitting and of a diameter slightly less than the width of said slotted opening, whereby, upon insertion through said slotted opening into said cavity and subsequent rotation therein by said hook member to a position wherein the crossbar is substantially perpendicular to said slotted opening and upon insertion of the lock plug into the remaining void so as to extend from a point external said slotted opening to a bottom wall surface of said cavity, the two components coact to form a coupling locked against disengagement from said lift fitting.

8. The cargo container hook apparatus of claim 7 wherein the distal end of the shank is formed to accommodate a lifting member.

9. The cargo container hook apparatus of claim 7 wherein the lock plug is loosely tethered to or near the hook member.

10. A cargo container hook apparatus for engaging a top wall of a hollow lift fitting having a cavity formed therein, said top wall having an elongated slot formed therethrough, such apparatus comprising:

a T-shaped hook member including an elongated shank formed on one end with an eye and formed on its opposite end with a crossbar having a pair of opposing distal ends formed thereon, said crossbar and shank being so sized and configured that said crossbar may be received lengthwise in said slot such that said shank may be rotated about its longitudinal axis to hook the opposite ends of said crossbar under such top wall of such fitting on the opposite sides of such slot, said hook member further so sized and configured as to be shiftable to one end of said slot to leave an opening at the opposite end thereof, each of said pair of distal ends of said crossbar having a substantially cylindrical cross sectional contour and a cylindrical plug sized and configured to be received in said opening for blocking longitudinal movement of said hook member in said hook member in said cavity to positively lock said hook member against disengagement from such fitting, said cylindrical plug extending from a first end disposed external said slot to a second end positioned contiguous a bottom wall surface of said cavity.

* * * * *